US006632301B2

(12) United States Patent
Krauss et al.

(10) Patent No.: US 6,632,301 B2
(45) Date of Patent: Oct. 14, 2003

(54) METHOD AND APPARATUS FOR BAINITE BLADES

(75) Inventors: George Krauss, Evergreen, CO (US); Rufus C. Benton, Princeton, NJ (US); Steven C. Voorhees, Pennington, NJ (US)

(73) Assignee: Benton Graphics, Inc., Hamilton, NJ (US)

( * ) Notice: Subject to any disclaimer, the term of this patent is extended or adjusted under 35 U.S.C. 154(b) by 44 days.

(21) Appl. No.: 09/727,920

(22) Filed: Dec. 1, 2000

(65) Prior Publication Data

US 2002/0100522 A1 Aug. 1, 2002

(51) Int. Cl.[7] ..... C21D 9/02
(52) U.S. Cl. ..... 148/579; 101/167
(58) Field of Search ..... 148/579; 101/151, 101/169, 155, 167

(56) References Cited

U.S. PATENT DOCUMENTS

| | | | | |
|---|---|---|---|---|
| 2,606,113 A | | 8/1952 | Payson | |
| 2,853,381 A | * | 9/1958 | Klaybor | 75/128 |
| 3,411,208 A | * | 11/1968 | Malm | 148/150 |
| 3,581,604 A | | 6/1971 | Malm | |
| 3,619,302 A | | 11/1971 | Aoki et al. | |
| 3,835,775 A | * | 9/1974 | Benton | 101/151 |
| 3,888,471 A | | 6/1975 | Coch | |
| 3,915,697 A | | 10/1975 | Giuliani et al. | |
| 3,953,250 A | | 4/1976 | Golland et al. | |
| 3,964,938 A | | 6/1976 | Tolliver et al. | |
| 4,023,988 A | | 5/1977 | Stickels et al. | |
| 4,033,789 A | | 7/1977 | Hamburg et al. | |
| 4,043,842 A | | 8/1977 | Joiret | |
| 4,046,598 A | | 9/1977 | Janzon | |
| 4,098,624 A | | 7/1978 | Laird, Jr. | |
| 4,115,155 A | | 9/1978 | Roe | |
| 4,140,524 A | | 2/1979 | Oberholtzer et al. | |
| 4,203,783 A | | 5/1980 | Economopoulos et al. | |
| 4,204,892 A | | 5/1980 | Economopoulos | |
| 4,219,371 A | | 8/1980 | Nakasugi et al. | |
| 4,222,793 A | | 9/1980 | Grindahl | |
| 4,225,365 A | | 9/1980 | Rice | |
| 4,249,964 A | | 2/1981 | Bambuch et al. | |
| 4,295,902 A | | 10/1981 | Economopoulos | |
| 4,343,661 A | | 8/1982 | Rice | |

(List continued on next page.)

OTHER PUBLICATIONS

H.K.D.H. Bhadeshia, Bainite In Steels, Transformations, Microstructute and Properties, Apr. 1992, Chapter 1, pp. 1–19, The Institute of Materials, London.

(List continued on next page.)

*Primary Examiner*—Scott Kastler
(74) *Attorney, Agent, or Firm*—Gibbons, Del Deo, Dolan, Griffinger & Vecchione

(57) ABSTRACT

The present invention includes bainitic steel doctor blades, bainitic steel coating blades, bainitic steel creping blades and bainitic steel rule die knives used in gravure printing, flexographic printing, paper making, die cutting of materials including paper, plastic, foam, leather, etc. Other uses include printing processes such as pad printing and electrostatic printing. The invention also includes an improved method for producing bainitic steel strip. The present invention is accomplished by using bainitic steel components that exhibit superior straightness and wear properties and are bendable around small radii. The process of the present invention comprises the steps of annealing a carbon steel resulting in a microstructure of the steel having a dispersion of carbides in a ferritic matrix; cold rolling the annealed steel; cleaning the cold rolled steel to remove oil and dirt; bridle braking the cleaned steel to increase strip tension; austenitizing the steel; submersing the austenitized steel into a quenchant; removing excess quenchant; and isothermally transforming the austenitized steel into bainite. The present process of the invention also includes the use of turn rolls that are housed in an assembly containing salt and/or tin.

19 Claims, 2 Drawing Sheets

U.S. PATENT DOCUMENTS 4,375,377 A 3/1983 Ohtani et al.
4,432,812 A 2/1984 Rice
4,470,854 A 9/1984 Nakamura
4,487,398 A 12/1984 Lincoln et al.
4,504,042 A 3/1985 Kruppert
4,596,606 A 6/1986 Kovacs et al.
4,634,476 A 1/1987 Bergson
4,737,202 A 4/1988 Muller et al.
4,793,869 A 12/1988 Krauss et al.
4,793,870 A 12/1988 Krauss et al.
4,812,182 A 3/1989 Fang et al.
4,816,090 A 3/1989 Doonan et al.
4,826,542 A 5/1989 Borodin
4,880,477 A 11/1989 Hayes et al.
4,895,071 A * 1/1990 Benton ..... 101/169
4,957,702 A 9/1990 Fang et al.
4,986,857 A 1/1991 Hewitt
5,028,281 A 7/1991 Hayes et al.
5,041,167 A 8/1991 Miwa
5,043,028 A 8/1991 Kovacs et al.
5,080,727 A 1/1992 Aihara et al.
5,082,507 A 1/1992 Curry
5,108,518 A 4/1992 Fukui et al.
5,123,970 A 6/1992 Fang et al.
5,139,579 A 8/1992 Kovacs et al.
5,156,691 A 10/1992 Hollenberg et al.
5,174,836 A 12/1992 Khare et al.
5,186,768 A 2/1993 Nomoto et al.
5,213,634 A 5/1993 DeArdo et al.
5,226,791 A 7/1993 Miwa et al.
5,292,384 A 3/1994 Klueh et al.
5,334,269 A 8/1994 Khare et al.
5,352,304 A 10/1994 DeArdo et al.
5,362,338 A 11/1994 Iwama et al.
5,374,322 A 12/1994 Okada et al.
5,382,307 A 1/1995 Kageyama et al.
5,431,753 A 7/1995 Kim et al.
5,514,065 A 5/1996 Noda et al.
5,522,949 A 6/1996 Widmer et al.
5,542,995 A 8/1996 Reilly
5,603,784 A 2/1997 Bay
5,665,182 A 9/1997 Kawana et al.
5,667,604 A 9/1997 Karch
5,840,136 A 11/1998 Maruki et al.
5,846,344 A 12/1998 Kawaguchi et al.
5,873,958 A 2/1999 Makii et al.
5,885,370 A 3/1999 Shimotomai et al.
5,888,321 A 3/1999 Kazama et al.
5,900,076 A 5/1999 Hayashi et al.
5,906,053 A 5/1999 Turner et al.
5,919,415 A 7/1999 Pichard
5,956,935 A 9/1999 Katayama et al.
6,045,630 A 4/2000 Fujiwara et al.
6,048,418 A 4/2000 Canner
6,074,765 A 6/2000 Pugh
6,086,685 A 7/2000 Joller et al.
6,096,146 A 8/2000 Poloni et al.
6,099,666 A 8/2000 Powell
6,110,296 A 8/2000 Zaranek

OTHER PUBLICATIONS

George Krauss, Steels: Heat Treatment and Processing Principles, Apr. 1990, Chapter 9, pp. 263–280, ASM International, Materials Park, Ohio 44073.
Roberts, Krauss & Kennedy, Tool Steels, 5th Edition, Apr. 1998, ASM International.
Anderson, et al., ASM Handbook—vol. 18—Friction, Lubrication and Wear Technology, Dec. 1992, ASM International.
Hti Austemper Process, www.callhti.com/austemper.html, No Date.
T. Calvin Tszeng, Current Projects, web page mmae.iit.edu/–tpc/t_calvin.html, No Date.
Boliver International, Air Cooled Bainite Steel Grinding Media, press release 1: www.boliver.com/press1.html, No Date.
Beijing Bainite Steel Corporation, www.china–times.com/bainite/Bainite.htm, No Date.
Boliver International, New Generation Bainitic Steels, press release 2: www.boliver.com/press2.html, No Date.
Role of Alloying Elements, www.msm.cam.ac.uk/phase–trans/bainitej.html, No Date.
Carbon in Bainite, www.msm.cam.ac.uk/phase–trans/bainitee.html, No Date.
Use of Bainitic Steels, web page www.msm.cam.ac.uk/phase–trans/bainitek.html, No Date.
The Transition from Upper to Lower Bainite, www.msm-.cam.ac.uk/phase–trans/bainiteg.html, No Date.
Lower Bainite, www.msm.cam.ac.uk/phase–trans/bainitec.html, No Date.
H.K.D.H Bhadeshia & D.V. Edmonds, Bainite in Silicon Steels, Parts 1 & 2, Metal Science, Sep. 1983, vol. 17.
R.J. Kar, R.M., Horn & V.F. Zackay, The Effect of Heat Treatment on Microstrucutre and Mechanical Properties in 52100 Steel, Metallurgical Transactions A, Nov. 1979, vol. 10 A.
P.R.T. Silva, G. Krauss, et al., Fatigue Behavior of 52100 Steel with Martenistic and Bainitic Microstructures, Proceedings of the 41st MWSP Conference, vol. XXXVII, Apr. 1999 ISS,.
G. Baozhu & G. Krauss, The Effect of Low–Temperature Isothermal Heat Treatments on the Fracture of 4340 Steel, Journal of Heat Treating, Dec. 1986, vol. 4, No. 4,.
V.T.T. Miihknen & D.V. Edmonds, Tensil Deformation of Two Experimental High–Strength Bainitic Low–Alloy Steels Containing Silicon, Material Science and Technology, Jun. 1987 vol. 3.

* cited by examiner 7
21
21
22
23
23
24
24
25
26
27

METHOD AND APPARATUS FOR BAINITE BLADES

CROSS-REFERENCE TO RELATED PATENT APPLICATIONS

STATEMENT REGARDING FEDERALLY SPONSORED RESEARCH OR DEVELOPMENT

Not Applicable.

BACKGROUND OF THE INVENTION

1. Field of the Invention

The present invention includes bainitic steel doctor blades, bainitic steel coating blades, bainitic steel creping blades and bainitic steel rule die knives ed in gravure printing, flexographic printing, paper making, die cutting of materials, such as, paper, plastic, foam, leather, etc. Other uses include printing processes such as pad printing and electrostatic printing, glue application arid other uses which will be apparent to those skilled in the art. This invention also relates to the process for producing bainite strip steel.

2. Discussion of Related Art

Various commercial industrial processes require metallic components that have extremely high straightness characteristics, high wear resistance and, in some cases, are also capable of being bent around small radii of bending. These components include doctor blades, used in such processes as flexographic and photogravure or gravure printing. Flexographic printing, formerly called analine printing, comprises a method of rotary printing utilizing flexible rubber plates and rapid drying fluid inks. Gravure printing is a printing technique wherein intaglio engravings of an image which are to be printed on a substrate, such as paper, are formed by known techniques on the surface of a gravure cylinder. Intaglio engravings are those where the elements to be printed are below the surface of the gravure cylinder, having been cut or etched into the metallic cylinder to form ink retaining cells. During printing, the gravure cylinder is immersed in fluid ink. As the cylinder rotates, ink fills tiny cells and covers the surface of the cylinder. The surface of the cylinder is wiped with a doctor blade, leaving the non-imaging area clean while the ink remains in the recessed cells in the cylinder. A substrate, such as paper stock, is brought into contact with the image carrier with the help of an impression roll. At the point of contact, ink is drawn out of the cells onto the substrate by capillary action.

Rule die knives are used in the cutting, creasing and perforating of various substrates such as, paper, cardboard, plastic, leather and foam.

Coating and creping blades are used in the manufacture of paper of various types wherein the blades are used to separate paper webs from calendar surfaces and used to apply coatings to the paper stock. Coating blades are also used to apply coatings, glue and protective films to a variety of substrates used in many different industrial processes.

While commercial tolerances of strip steel may generally have a straightness, referred to as camber, of about 0.375 inch per four feet, doctor blades and rule die knives used in the flexographic and gravure printing processes require a camber of a maximum of about 0.040 inch per ten feet and preferably about 0.024 inch per ten feet. This requirement is nearly one-hundred times more stringent than the tolerances in commercially supplied strip steel. Presently, there are very few manufacturers, none of which manufacture in the United States, that produce strip steel for the manufacture of these products. As a result of the limited suppliers and their foreign residences, these components are not only expensive, but are also susceptible to periods of unavailability.

In addition to low tolerances for straightness, it is desirable that doctor blades and rule die knives have relatively long useful service lives. Gravure and flexographic printing equipment are universally recognized to be expensive, and the labor costs associated with running these printing operations are significant. Printing pressmen are highly skilled and command high labor costs. It should readily be appreciated that anytime a gravure press or flexographic press is not operating during periods when it is supposed to be producing a printed substrate (downtime), significant costs are expended. Such costs are not likely to be recouped. Downtime may also result in the failure to meet printing deadlines. Thus, it is highly desirable to use doctor blades and rule die knives that require as few replacements as possible because such components can only be replaced during downtime.

These components are presently made of high carbon steel containing about 0.80% to 1.25% carbon by weight that is hardened and tempered to a martensitic structure. Martensite, a very hard and brittle microstructure in steel, has a fine, needlelike appearance under a microscope. While there is some correlation between higher hardness of this type of steel and better wear resistance, there is a limit to increases in hardness of martensitic steels to improve wear resistance due to the added brittleness that accompanies higher hardness. A practical limit of 54 Rockwell C is generally acknowledged, above which the parts become too brittle for use in printing press applications. A hardness of Rockwell of 48–52 Rockwell C is preferable.

Factors that contribute to the wear of doctor blades include a combination of abrasive wear, adhesive wear and wet impingement wear. Depending on the specific application any one or more than one of these types of wear may significantly contribute to reducing the wear life of doctor blades.

Attempts to improve wear properties of these components have included coating the wear surface with metallic materials such as chromium and non-metallic materials such as TiN, diamond, nitrides, $SiO_2$ and sprayed ceramic. There also has been some use of edge hardening on alloy steels. While these methods improve wear resistance, they are expensive to apply and do little or nothing to change the camber. In certain instances, these processes actually can be deleterious to camber due to the high temperatures encountered in the particular process causing stress relief or thermal distortion, In attempts to solve some of the technical problems associated with martensitic steel, the a use of cold rolled eutectic carbon steels with tensile strengths in excess of 300,000 psi has met with some success in gravure printing with water based inks. Cold rolled austenitic stainless steels were used for some time, but have been replaced by martensitic stainless steels.

Some have offered alloy steels and special high carbon steels such as SAE 52100, but these alternatives still contain martensitic structures. These special high carbon steel components therefore have the drawbacks of being expensive and/or show little improvement in useful wear life. Notably, none of these martensitic steels have answered the problem of long-term camber being greater than desired.

Coating and creping blades used in paper manufacturing have similar requirements to those of doctor blades. Because these blades are usually made of thicker material in the range of 0.024–0.060 inch there seems to be less problem with camber, but wear problems persist.

Rule die knives have requirements similar to those of doctor blades in that they must be very straight and durable. They must be sufficiently hard to permit edge sharpening, and they also must exhibit good sharpness retention when used to cut abrasive materials including kraft paper, coated stock and abrasive plastics. In addition, however, rule die knives also must be capable of being bent with small radii of bending.

In the past, this requirement has been met by various means including employing a softer metal, hardening the cutting edge, decarburizing the outer surfaces of the blade to depths of 0.003–0.006 inches, laser hardening of the cutting surface only and induction hardening after bending. All of these means are expensive.

It is believed that martensitic steel has not been successful with respect to camber requirements of doctor blades and die knife blades because of distortions that occur as a result of the austenitizing, quenching and tempering operations used in manufacturing the martensite. Quenching is the rapid cooling process in which the heated steel is plunged into a liquid or other medium to harden the metal. The heated steel, which has a temperature in excess of 1400° F. and is in austenite form, is rapidly cooled to room temperature, changing from austenite to martensite.

Because martensite is very strong and hard, yet very brittle, it is generally tempered. Tempering involves reheating the quenched steel to a temperature that is below the steel's lower transformation temperature to increase ductility and relieve stress. The lower transformation temperature is the temperature at which the formation of austenite begins. Relief of rolling stresses in the metal, thermal distortion during heat up, metallurgical structural changes with resulting changes in dimensions together with quench distortion all contribute to the camber problem.

Martempering and austempering have been used to address some of the distortion and dimension problems. These two alternatives involve heat treatments interrupted by cooling operations rather than quenching to room temperature.

Martempering is a process where steel, heated to the austenitizing temperature, is quenched to an intermediate temperature above the martensite start temperature, $M_s$, and held at that temperature for such duration that the temperature of the entire material is equalized. When temperature equilibrium is established, the steel is then slowly reduced in temperature, to room temperature. During this period, there is a generally uniform transformation from austenite to martensite throughout the cross section of the steel. This process produces steel with a microstructure of untempered martensite. It is very brittle and highly stressed. To regain toughness and ductility so that this steel can be used in mechanical operations, it must be tempered back resulting in some reduction of hardness and ultimate strength.

Commercial heat treating lines of the type used to manufacture steel for doctor blades use a form of martempering wherein the temperature is first reduced from austenitizing temperature by a rapid quench into either molten lead or molten salt at a temperature above the $M_s$. The steel is then removed from the quench medium and air cooled to room temperature before it is heated again to perform a tempering operation on the untempered martensitic steel. The temperature of the quench media is not critical so long as it is above $M_s$ and well below the knee of the Time-Temperature-Transformation (TTT) curve, thus preventing the formation of pearlite which contains a softer microstructure than does martensite.

Austempering is a process that involves heating the steel to austenitizing temperature, then quenching it in lead or salt to a temperature above $M_s$ and then holding it for about twenty minutes to two hours at a specific temperature selected for the steel composition and desired hardness. During this holding time, the steel structure changes from austenite to bainite, a specific microstructure different from martensite. The bainitic microstructure consists of ferrite crystals and dispersed carbides formed from the austenite produced by the high temperature austenitizing. The isothermal hold time permits the carbon atoms to diffuse to form carbide crystals, leaving the surrounding ferrite low in carbon content. In contrast, when austenite transforms to martensite, there is insufficient time for carbon atom diffusion and consequently martensite is supersaturated with carbon atoms trapped between the iron atoms. This creates high stress, distortion, and an increased tendency to brittle fracture. Also contributing to the latter characteristics of martensite, is a high density of crystal imperfections within the martensite caused by the quenching and diffusionless transformation process.

The ferritic matrix of bainite produced by isothermal transformation, in addition to the absence of carbon atom supersaturation, has a much lower density of imperfections and therefore reduced internal stresses and reduced sensitivity to brittle fracture as compared to martensitic steel. Thus, tempering is not required for bainitic microstructures, especially in high-carbon steels in which high hardness and wear resistance are required. Following the bainitic conversion, the material is cooled to room temperature. No further operations, such as tempering, are required. There is generally less distortion of material, i.e. less dimensional change in the microstructure size and density as compared to the conversion to martensite due to the more gentle conversion to bainite.

The austempering process provides less distortion, i.e. less dimensional change in size or density of material as compared to the conversion to martensite due to the more gentle conversion to bainite in the bainite process, and the elimination of the tempering operation which is to some extent a stress relieving operation. The obvious disadvantage to the austempering process is the long holding times at a precise temperature. For heat-treating individual parts, this limitation is not too severe. For continuous strip production, however, the cost of the large holding time and area, as well as the low production rates make the process commercially uneconomical.

It should be noted that many of these processes use anti-friction bearings to move or turn the steel during manufacture. Anti-friction bearings are defined herein to be bearings that replace sliding friction with rolling friction and include ball, needle, roller and tapered roller bearings Conventional anti-friction bearings are subject to very short useful lives because of environmental conditions. The combination of oxidation of lubricants, tempering, abrasive oxides from the strip, dimensional changes during heating and cooling and seal failure contribute to very rapid destruction of these bearings. Commonly available bearings typically do not last more than a few hours at temperatures that may be as high as 650° F. In some cases, failure occurred in a single run causing bearings to seize and damage to the strip being processed.

What is needed is an improved doctor blade for use in printing operations.

What is further needed is a doctor blade that exhibits high straightness and low wear.

What is further needed is an improved doctor blade that has a good working life.

What is further needed is a doctor blade that minimizes press downtime,

What is further needed is a doctor blade that is economical in cost.

What is further needed is a doctor blade comprised of steel wherein the steel microstructure is substantially all in bainitic form.

What is further needed is a doctor blade comprising a carbon steel and at least one alloying element selected from chromium, vanadium, manganese, tungsten and niobium wherein the microstructure is substantially bainitic.

What is further needed is a doctor blade comprised of high carbon steel having a bainitic microstructure wherein the carbon content is generally within the range of 0.70% to 1.25% by weight.

What is further needed is an improved rule die knife for use in cutting operations.

What is further needed is a rule die knife that exhibits high straightness, low wear and is capable of being bent around a small radius.

What is further needed is an improved rule die knife that has a good working life, What is further needed is a rule die knife that minimizes machine downtime.

What is further needed is a rule die knife that is economical in cost,

What is further needed is a rule die knife comprised of steel wherein the steel microstructure is substantially all in bainitic form, What is further needed is a rule die knife comprised of high carbon steel having a bainitic microstructure wherein the carbon content is generally within the range of 0.70% to 1.25% carbon by weight, What is further needed is a rule die knife comprising carbon steel and at least one alloying element selected from chromium, vanadium, manganese, tungsten and niobium wherein the microstructure is substantially bainitic.

What is further needed is an improved coating blade for use in coating operations.

What is further needed is a coating blade that exhibits high straightness, low wear and is capable of being bent around a small radius, What is further needed is an improved coating blade that has a good working life.

What is further needed is a coating blade that minimizes machine downtime.

What is further needed is a coating blade that is economical in cost.

What is further needed is a coating blade comprised of steel wherein the steel microstructure is substantially all in bainitic form.

What is further needed is a coating blade comprised of high carbon steel having a bainitic microstructure wherein the carbon content is generally within the range of 0.70% to 1.25% carbon by weight.

What is further needed is a coating blade comprising carbon steel and at least one alloying element selected from chromium, vanadium, manganese, tungsten and niobium wherein the microstructure is substantially bainitic.

What is further needed is an improved creping blade for use in paper making operations.

What is further needed is an improved creping blade that has a good working life.

What is further needed is a creping blade that minimizes machine downtime,

What is further needed is a creping blade that is economical in cost.

What is further needed is a creping blade comprised of steel wherein the steel microstructure is substantially all in bainitic form.

What is further needed is a creping blade comprised of high carbon steel having a bainitic microstructure wherein the carbon content is generally within the range of 0.70% to 1.25% carbon by weight.

What is further needed is a creping blade comprising carbon steel and at least one alloying element selected from chromium, vanadium, manganese, tungsten and niobium wherein the microstructure is substantially bainitic.

What is further needed is a bainitic steel strip having very high straightness arid low wear.

What is further needed is bainitic steel strip having a camber of about 0.040 inch per ten feet of length and, preferably, 0.024 inch per ten feet of length.

What is further needed is bainitic steel strip having a high straightness, low wear and a hardness range of 48–60 Rockwell C with little brittleness.

What is further needed is an improved process for producing bainitic steel strip.

What is further needed is an improved process for producing bainitic steel strip that overcomes the problem of bearing failure during production of the bainite What is further needed is a printing process that uses at least one of a bainitic steel doctor blade, bainitic rule die knife, bainitic steel creping blade or bainitic steel coating blade.

What is further needed is a process for flexographic printing using at least one of a bainitic steel doctor blade, bainitic steel rule die Life, bainitic steel creping blade or bainitic steel coating blade.

What is further needed is a process for gravure printing using bainitic steel components.

What is further needed is a process for pad printing using bainitic steel components.

What is further needed is a process for electrostatic printing, glue application, die cutting, coating and paper making using bainitic steel components, What is further needed is a high temperature bearing assembly used in the process of producing bainite strip steel wherein salt is used as a protective agent against oxidation and/or deterioration of the bearing assembly.

What is further needed is a high temperature bearing assembly used in the process of producing bainite strip steel wherein tin is used as a protective agent against oxidation and/or deterioration of the bearing assembly.

What is further needed is heat treating equipment used in the process for producing bainitic strip steel wherein salt is used as a protective agent against oxidation and/or deterioration.

What is further needed is heat treating equipment used in the process for producing bainitic strip steel wherein tin is used as a protective agent against oxidation and/or deterioration.

Other objects of the present invention will become apparent to those of ordinary skill in the art.

BRIEF SUMMARY OF THE INVENTION

The present invention is directed to doctor blades, rule die knives, creping blades and to coating blades comprised of bainitic steel and to a method for producing bainitic steel strip. The present invention also provides for printing and other processes that use bainitic components and, bainite production processes that preserve the useful life of anti-friction bearings used therein.

The present invention is accomplished by using bainitic steel that exhibits superior straightness and wear properties and is also bendable around small radii. The bainitic steel is produced by continuously heat-treating steel strip steel under tension in a manner to produce a bainitic microstructure of a specific hardness, strength and microstructure. The initial steel must have a specific microstructure to maximize the wear properties and the straightness of the final product. Tension must be controlled so that elongation minimizes the size reduction of the strip.

The process of the present invention comprises the steps of, annealing a carbon steel resulting in a microstructure of the steel having a dispersion of carbides in a ferritic matrix; cold rolling the annealed steel; cleaning the cold rolled steel to remove oil and dirt; bridle roll and/or friction braking the cleaned steel to increase strip tension; austenitizing the steel, submersing the austenitized steel into a quenchant; removing excess quenchant; and isothermally transforming the austenitized steel into bainite.

DETAILED DESCRIPTION OF THE INVENTION

Carbon steel treated by the method of this invention contains carbon generally within the range of 0.70% to 1.25% by weight. In addition to carbon, other elements may include chromium, vanadium, tungsten, manganese and niobium. These elements may be added at such levels that they become carbide forming elements but are in small enough quantities so as not to increase material costs significantly. Upon tightly controlled spherodized annealing of the hot band steel prior to cold rolling, the steel contains preferably a dispersion of iron and/or alloy carbides in a ferritic matrix where the majority of the carbides range in sizes from 0.50$\mu$to 0.75$\mu$. The steel is then cold rolled to a thickness in the range of 0.003 inch to 0.050 inch. At this point the steel should have a hardness of 25–35 Rockwell C. Depending on the amount of rolling stresses induced in hard rolling and slitting, it may be advantageous to tension level the material.

Figure 1:
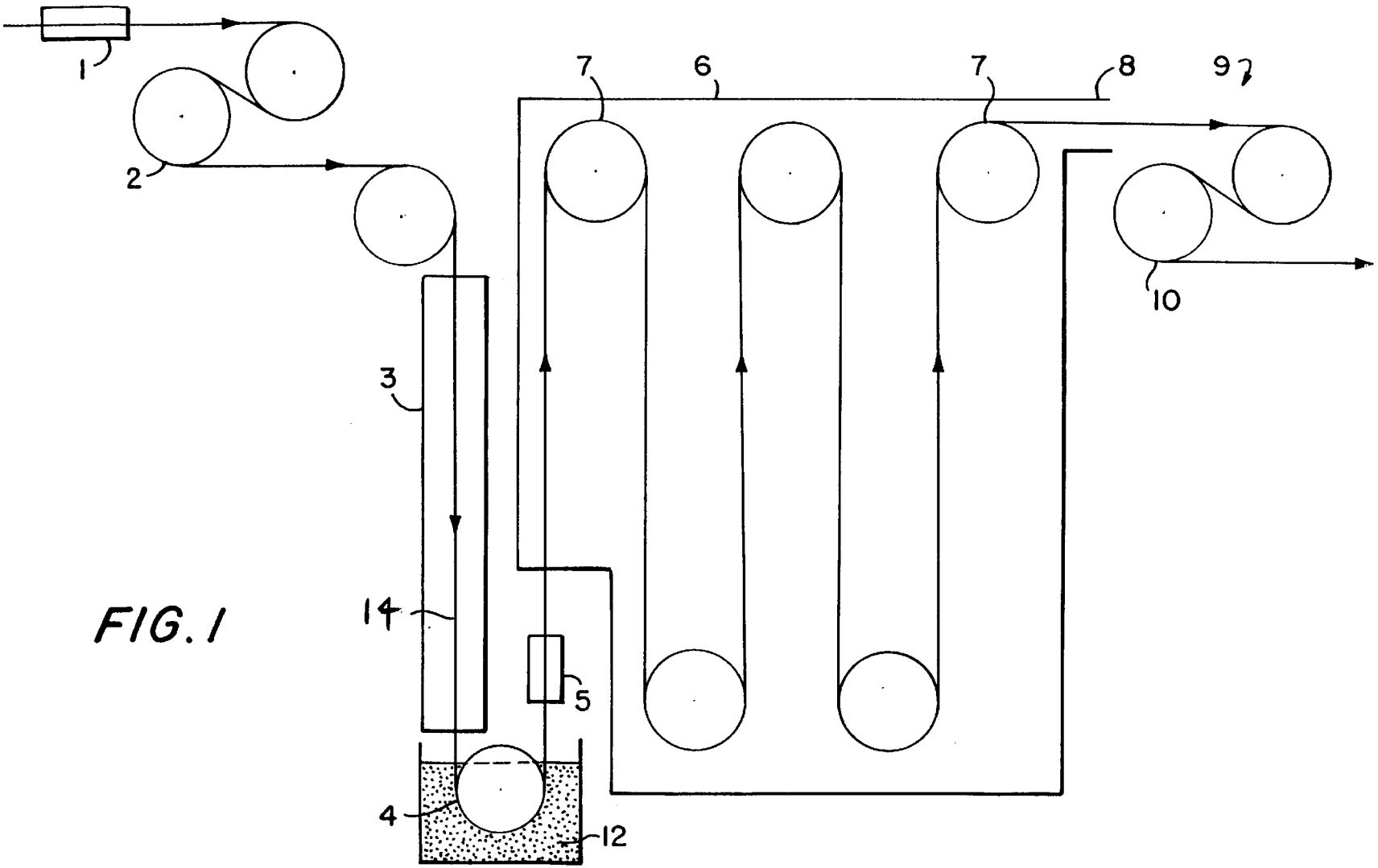
FIG. 1 is a schematic illustration of the production process for bainite.

Referring to FIG. 1, the material passes through a cleaning station 1 to remove protective oil and dirt and then proceeds to a bridle roll braking system 2 to increase the strip tension to a value between 1000 and 5000 psi. The tensioned strip 14 then proceeds into a vertical austenitizing tower 3 where it is heated under a controlled atmosphere. The line speed and tower length are determined by the times and temperatures required to properly austentize the particular steel being processed. For the purposes of the invention, the austenitizing step provides a controlled dissolution of ferrous and alloy carbides, thereby providing a dispersion of residual spherodized carbides in a matrix of austenite containing a lower carbon content than the nominal carbon content of the steel prior to such treatments. In addition to providing a mechanism for adjusting the carbon content of the austenite that subsequently transforms to bainite, the residual carbides also maintain a fine austenitic grain size for good fracture resistance. The control of austenitizing time and temperature and the residual carbide particles also insure that a fine-grained austenite is produced.

Exiting the base of the tower 3, the strip 14 proceeds down to a turn roll assembly 4 which is submersed in a quenchant 12, such as molten salt or tin maintained at a temperature above the martensite start temperature ($M_s$) but well below the knee of the TTT curve. Preferably the quenchant should wet the steel strip to insure protection against oxidation in further processing steps. The line tension maintains the steel flat against the turn roll assembly 4. In addition to strip tension, quench temperature and quenchant level are adjusted for strip flatness and straightness.

The strip 14 then proceeds through a temperature controlled wiping section 5 where excess quenchant is removed leaving only a thin layer of quenchant to prevent oxidation in later stages.

The strip 14 then proceeds into an isothermal holding chamber 6 where the strip 14 is maintained at a temperature that causes the austenite, produced in the high-temperature austenitizing step, to produce bainite of a desired hardness and microstructure. The bainitic microstructure of this invention is typically referred to as lower bainite in which fine carbide particles are contained intragranularly within ferrite crystals.

The amount of the austenite that transforms to bainite depends on the alloy content and the time and temperature of the isothermal hold. Some austenite may be retained or partially transformed to martensite on cooling to room temperature. The holding chamber 6 is designed with multiple turn around rolls 7 to allow the strip 14 to see reversals in bending during the transformation from austenite to bainite. Referring to turn around rolls 7 in FIG. 1, it is seen that the strip being processed reverses direction each time it goes around subsequent rolls. Since holding chamber 6 contains many such rolls 7, the material is constantly being reversed as the transformation from austenite to bainite takes place. While FIG. 1 shows a plurality of rolls, it should be recognized that Applicant believes that the preferred number of rolls is fifteen. The bending direction is reversed in direction as the strip follows the turn rolls 7. The structure of the strip upon examination would show a progression from fully austenitic condition at the entry to fully bainitic condition at the exit and a mixture of both at any point therebetween. The flatness and the camber of the strip continuously improve as the conversion to bainite takes place. It is believed that the combination of the strip tension, reversing of the bending and the holding of the strip flat against the turn rolls 7 all contribute to this improvement without inducing coil set in the finished product. This reversing design also permits reasonably sized equipment to house the length of the strip required for twenty (20) to thirty (30) minutes holding time at a temperature to allow the formation of the intragranular carbides structure of lower bainite.

Holding chamber 6 is preferably an electrically heated, circulating air unit. Circulating hot air is possible because the salt or tin coating on the strip 14 prevents oxidation at the holding temperature. Inert atmosphere, with its high attendant cost, is not required.

Figure 2:
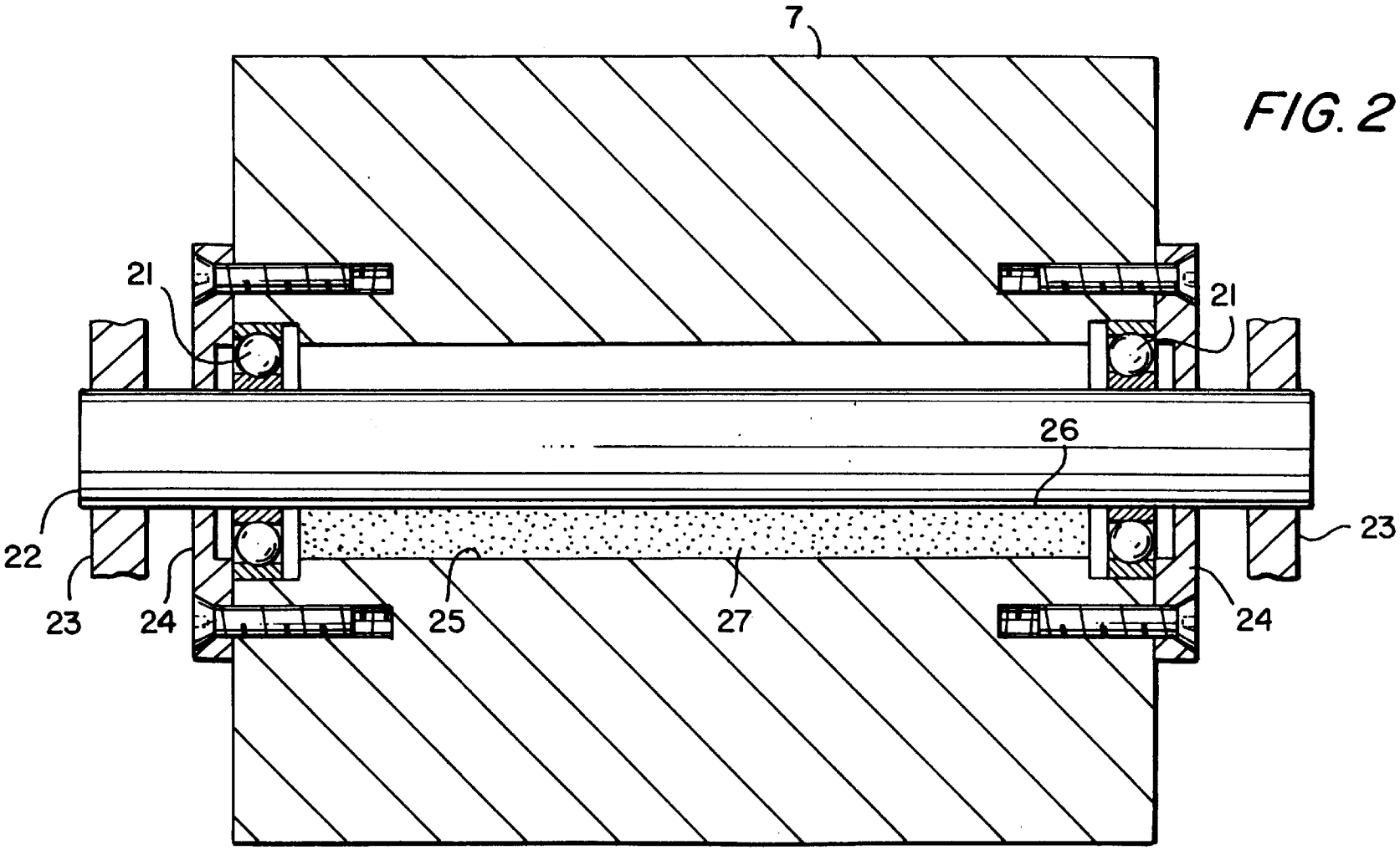
FIG. 2 is a cross section of the high temperature bearing assembly.

Turn rolls 7 are mounted on ball bearings 21 that are housed in an assembly that contains quench salt (FIG. 2), This arrangement overcomes the problem of bearing failure as discussed above. Ball bearings 21 are mounted on a stationary shaft 22, which are in turn attached to the frame 23 of the chamber 6. The turn rolls 7, mounted on the bearings 21 and shield plates 24, form a loose seal around the shaft 22. On assembly, cavity 25 is filled with loose salt that melts down to level 26 upon heating above the melting point of the salt. As the roll rotates at operating temperature, the molten salt 27 continuously coats the inside cavity components 25 thereby preventing oxidation of said components including said ball bearings 21. All components are cleaned prior to assembly to remove grease, lubricants, oils and any particulate matter. Seals, if any, are removed from the bearings 21. These assemblies can operate for hundreds of hours without signs of wear or roughness even when exposed to loads as high as 300 pounds. As in the case of quench roll 4 (FIG. 1), strip tension forces the strip to remain flat against turn rolls 7 aiding in shape control during the isothermal transformation.

The strip 14 leaves the holding chamber 6 through tunnel 8 into a cooling zone 9 where it is cooled to room temperature under tension. The strip then is wrapped around bridle drive 10 that sets the line speed. The strip 14 can then be coiled or further processed by conventional means such as washing to remove residual salt and applying a protective coating.

The use of bainite doctor blades and bainite rule die Dives in printing operations yield very surprising and unexpected results. The bainite wear rates were Up to 40% longer as compared to the wear rates of corresponding martensite components. Further, the wear particles of the bainitic steel components were substantially smaller than the particles from the martensitic steels. In addition, slow bending of the bainitic steel permitted bending the bainitic steel around small radii. These results were shown through the following examples described further below.

A prototype line was built to produce bainitic strip steel to determine if long-term camber could be improved. Bainitic steels were compared to martensitic steels when run with standard inks and various anilox rolls. Comparisons showed that commercial martensitic steel wore at rates as high as 60% faster than did bainitic steel.

Table I shows seven materials that were tested on a Flexographic wear tester. The steels used in runs one through seven consecutively, included Sandvik, Microflex II, GET, Regal/Spang material (1.25C.3Cr), Tiger Pro 460 (Theis 1095 flapper), Microloy Alloy and Uddeholm Qrowt. Materials designated as 1, 2, 3 and 7 were tested, but were not heat treated. Materials designated as 4, 5 and 6 underwent production to bainitic form in accordance with the invention.

TABLE I

CHEMICAL COMPOSITION & SIZE

| RUN | C | S | P | Si | Cr | Ni | Mn | Mo | Al | V | W | Cu |
|---|---|---|---|---|---|---|---|---|---|---|---|---|
| 1 | 0.984 | 0.006 | 0.010 | 0.21 | 0.13 | 0.09 | 0.47 | 0.02 | 0.028 | — | — | 0.05 |
| 2 | 1.03 | 0.013 | 0.023 | 0.30 | 1.40 | 0.14 | 0.29 | 0.04 | 0.052 | 0.01 | 0.02 | 0.27 |
| 3 | 0.83 | 0.008 | 0.020 | 0.20 | 0.10 | — | 0.40 | — | — | — | — | — |
| 4 | 1.22 | 0.008 | 0.012 | 0.20 | 0.36 | 0.04 | 0.31 | 0.023 | 0.005 | 0.006 | — | 0.05 |
| 5 | 0.97 | 0.003 | 0.006 | 0.25 | 0.17 | 0.12 | 0.43 | 0.03 | 0.019 | — | — | 0.18 |
| 6 | 0.941 | 0.006 | 0.026 | 0.29 | 0.60 | 0.15 | 1.2 | 0.04 | 0.050 | 0.085 | 0.56 | 0.22 |
| 7 | 0.52 | .001 | 0.016 | 0.30 | 2.61 | 0.10 | 0.75 | 2.28 | — | 0.90 | — | 0.06 |

Table II shows the processing Parameters for producing bainite by heat treating in accordance with the invention.

All bainitic samples were run at 1.5 inch/second line speed. Austentizing was performed under nitrogen atmosphere and quenching was completed in a salt quench. The isothermal transformation to bainite was done by holding in air. All wear tester sample surfaces were ground to 1.00" wide by 8.0" long and thicknesses of both 0.006" and 0.008" were tested for hardness.

TABLE II

PROCESSING PARAMETERS AND RESULTING HARDNESS

| RUN NUMBER | AUSTENTIZIN TEMP. F. | QUENCH TEMP. F. | ISOTHERMAL TEMP. F. | HARDNESS $R_c$ | MATERIAL HEAT-TREATED |
|---|---|---|---|---|---|
| I007-98 | 1475 | 450 | 460 | 60 | 1095 alloy |
| U0330-A | 1475 | 546 | 500 | 55.6 | Microloy ™ alloy |
| U0411-A | 1550 | 550 | 530 | 55.4 | Microloy ™ alloy |
| U0516-A | 1480 | 423 | 550 | 54.0 | Microloy ™ alloy |
| U1110-B | 1505 | 465 | 610 | 51.6 | Microloy ™ alloy |

As shown from each of the sample runs, levels within the range of 51.6 to 60.0 Rockwell C were achieved.

Table III shows the wear testing results on currently available Martensitic steels including Sandvik, Uddeholm and Eberle. These were used to determine the best standard martensitic material for comparison to bainitic steel in accordance with the process of the invention.

TABLE III

WEAR TESTING RESULTS

| MATERIAL | SAMPLE # | START WT. GMS | FINISH WT. GMS | REMOVED WT. GMS | WEAR RATE |
|---|---|---|---|---|---|
| Uddeholm | B-4 | 8.1763 | 8.0757 | 0.1006 | 0.028/Hr |
| Eberle | B-5 | 8.2095 | 8.1103 | 0.0992 | 0.0275/Hr |
| Sandvik | B-6 | 8.2345 | 8.1490 | 0.0855 | 0.0237/Hr |

As can be seen by the results in Table III, Sandvik showed the lowest wear rate of standard martensitic steels. Thus, Sandvik was chosen as the base line standard for commercially available martensitic steel.

Table IV shows the comparison results of Sandvik to bainitic steels produced in accordance with the invention.

TABLE IV

COMPARISONS

| MATERIAL | SAMPLE # | START WT. GMS | FINISH WT. GMS | REMOVED WT. GMS | WEAR RATE |
|---|---|---|---|---|---|
| A1 Sandvik | A-1 | 8.1903 | 8.0435 | 0.1468 | 0.0419 |
| A2 1.25 C.3 Cr | A-2 | 8.2508 | 8.1597 | 0.0911 | 0.0260 |
| A3 1095 (Tiger) | A-3 | 8.0455 | 7.9557 | 0.0898 | 0.0257 |
| A4 Sandvik | 400-8 | 6.0630 | 5.0747 | 0.9883 | 0.04297 |
| A5 Microloy | 400-9 | 6.0181 | 5.3879 | 0.6302 | 0.0274 |

Test runs A-1 through A-3 indicate an improved wear rate for the bainitic steel of up to 63%, runs A-4 through A-5 show an improved wear rate up to 56.8%.

Although these sample runs describe particular embodiments of the invention, many other variations and modifications and other uses may become apparent to those skilled in the art. It is preferred, that the present invention not be limited by this specific disclosure herein, but only by the appended claims.

What is claimed is:

1. A process of inking a surface and thereafter providing and causing wear of a doctor blade, comprising the steps of:

filling ink retaining cells of a surface with ink and covering the surface with excess ink;

providing a bainitic doctor blade that is structured of bainitic strip steel having a bainite microstructure in which fine carbide particles are contained intragranularly within ferrite crystals and having a hardness within a range of about 51.6 to 60.0 Rockwell C; and wiping away the excess ink that is covering the surface, the wiping being done with the bainitic doctor blade, the wiping causing the baintic doctor blade to wear at a rate, because of the bainite microstructure, that is lower than that for a corresponding martensitic doctor blade.

2. A process as in claim 1 in combination with printing, further comprising drawing ink out of the ink retaining cells; and printing on a substrate with the drawn out ink.

3. A process as in claim 2 wherein the printing is gravure printing, the surface is part of a gravure cylinder that has the ink retaining cells.

4. A process as in claim 2 wherein printing is flexographic printing.

5. A process as in claim 2 wherein the printing is pad printing.

6. A bainitic doctor blade, comprising:

a doctor blade that is structured of bainitic strip steel having a bainite microstructure in which fine carbide particles are contained intragranularly within ferrite crystals and having a hardness within a range of about 51.6 to 60.0 Rockwell C; the doctor blade thereby being bainitic and being configured to wipe away ink that is covering a surface having ink retaining cells tilled with ink so that the doctor blade wears at a rate, because of the bainite microstructure, that is lower than that for a corresponding martensitic doctor blade.

7. The process as in any of claims 1–5, wherein the providing of the doctor blade includes forming the bainitic doctor blade from the bainitic strip steel and producing the bainitic strip steel by:

(a) annealing a carbon steel resulting in a microstructure of carbon steel having a dispersion of iron carbides in a ferritic matrix;

(b) cold rolling the annealed steel;

(c) cleaning the cold rolled steel to remove oil and dirt;

(d) braking the cleaned steel to increase strip tension;

(e) austenitizing of the tensioned steel;

(f) submersing the austenitized steel into a quenchant;

(g) removing excess quenchant from the austenitized steel; and (h) isothermally transforming the austenitized steel into bainite.

8. The process of claim 1 wherein step (a) results in a microstructure of carbon steel having a dispersion of iron carbides and alloy carbides in a ferritic matrix.

9. The process of claim 1 further comprising the step of tension leveling the steel subsequent to the step of cold rolling the annealed steel.

10. The process of claim 1 further comprising the step of wrapping the bainite steel strip around a quench roll for shaping.

11. The process of claim 1 further comprising the step of applying a protective coating on the bainite steel.

12. The process of claim 1 wherein the carbon steel to be annealed contains carbon generally within range of 0.70% to 1.25% by weight.

13. The process of claim 1 wherein the steel to be annealed contains at least one of chromium, vanadium, tungsten, niobium and manganese to form carbide elements and to control hardenability.

14. The process of claim 1 wherein during step (b) the steel is cold rolled to thicknesses within the range of 0.003 inch and 0.050 inch.

15. The process of claim 1 wherein during step (b) the steel is slit to widths within the range of 0.5 inches and 5.0 inches.

16. The process of claim 1 wherein during step (h) the austenitized steel is isothermally transformed into bainite steel in a holding chamber comprising a plurality of reversing turn rolls.

17. The process of claim 1 wherein during step (h) a residue of quenchant is left on the strip steel to retard oxidation during holding time to achieve bainitic transformation and to permit the use of an air atmosphere.

18. The process of claim 1 wherein the annealed steel to be cold rolled has a spherical carbide dispersion matrix of carbides substantially within a size range of $0.50\mu$ to $0.75\mu$, the carbides being selected from a group consisting of iron carbides and of iron and alloy carbides.

19. The method of claim 1 wherein step (e) consists substantially of austenitizing the tensioned steel under a nitrogen atmosphere.

* * * * *